US010056693B2

(12) United States Patent
Shtrom

(10) Patent No.: US 10,056,693 B2
(45) Date of Patent: Aug. 21, 2018

(54) PATTERN SHAPING OF RF EMISSION PATTERNS

(71) Applicant: RUCKUS WIRELESS, INC., Sunnyvale, CA (US)

(72) Inventor: Victor Shtrom, Los Altos, CA (US)

(73) Assignee: RUCKUS WIRELESS, INC., Sunnyvale, CA (US)

( * ) Notice: Subject to any disclaimer, the term of this patent is extended or adjusted under 35 U.S.C. 154(b) by 0 days.

(21) Appl. No.: 15/050,233

(22) Filed: Feb. 22, 2016

(65) Prior Publication Data

US 2016/0248160 A1 Aug. 25, 2016

Related U.S. Application Data

(63) Continuation of application No. 14/242,689, filed on Apr. 1, 2014, now Pat. No. 9,270,029, which is a continuation of application No. 13/731,273, filed on Dec. 31, 2012, now Pat. No. 8,686,905, which is a continuation of application No. 13/305,609, filed on Nov. 28, 2011, now Pat. No. 8,358,248, which is a continuation of application No. 12/953,324, filed on (Continued)

(51) Int. Cl.

| | |
|---|---|
| ***H01Q 1/24*** | (2006.01) |
| ***H01Q 9/16*** | (2006.01) |
| ***H01Q 1/38*** | (2006.01) |
| ***H01Q 1/42*** | (2006.01) |
| ***H01Q 9/28*** | (2006.01) |
| ***H01Q 19/00*** | (2006.01) |
| ***H01Q 21/26*** | (2006.01) |
| ***H01Q 19/02*** | (2006.01) |

(52) U.S. Cl.

CPC ..... *H01Q 9/16* (2013.01); *H01Q 1/241* (2013.01); *H01Q 1/243* (2013.01); *H01Q 1/38* (2013.01); *H01Q 1/42* (2013.01); *H01Q 9/285* (2013.01); *H01Q 19/00* (2013.01); *H01Q 19/021* (2013.01); *H01Q 21/26* (2013.01)

(58) Field of Classification Search

CPC ..... H01Q 1/24; H01Q 9/16; H01Q 1/38

USPC ..... 343/700 MS, 702, 767, 770–771, 876, 343/833

See application file for complete search history.

(56) References Cited

U.S. PATENT DOCUMENTS 723,188 A 3/1903 Tesla
725,605 A 4/1903 Tesla (Continued)

FOREIGN PATENT DOCUMENTS

AU 2003/227399 10/2003
CA 2494982 10/2003

(Continued)

OTHER PUBLICATIONS

ACM Digital Library, "Hotspots Shared Keys" ACM, Inc. 2014. Date of download: Nov. 24, 2014.

(Continued)

*Primary Examiner* — Huedung Mancuso

(74) *Attorney, Agent, or Firm* — Lewis Roca Rothgerber Christie LLP

(57) ABSTRACT

A metallic shaping plate located in the interior housing of a wireless device is disclosed. The metallic shaping plate may influence a radiation pattern being generated by a horizontal antenna array. The result may be an increase in the gain of the array.

12 Claims, 7 Drawing Sheets

Related U.S. Application Data

Nov. 23, 2010, now Pat. No. 8,085,206, which is a continuation of application No. 11/971,210, filed on Jan. 8, 2008, now Pat. No. 7,893,882.

(60) Provisional application No. 60/883,962, filed on Jan. 8, 2007.

(56) References Cited

U.S. PATENT DOCUMENTS

| | | | |
|---|---|---|---|
| 1,869,659 | A | 8/1932 | Broertjes |
| 2,292,387 | A | 8/1942 | Markey et al. |
| 3,488,445 | A | 1/1970 | Chang |
| 3,568,105 | A | 3/1971 | Felsenheld |
| 3,721,990 | A | 3/1973 | Gibson et al. |
| 3,887,925 | A | 6/1975 | Ranghelli |
| 3,967,067 | A | 6/1976 | Potter |
| 3,969,730 | A | 7/1976 | Fuchser |
| 3,982,214 | A | 9/1976 | Burns |
| 3,991,273 | A | 11/1976 | Mathes |
| 4,001,734 | A | 1/1977 | Burns |
| 4,027,307 | A | 5/1977 | Litchford |
| 4,176,356 | A | 11/1979 | Foster et al. |
| 4,193,077 | A | 3/1980 | Greenberg et al. |
| 4,203,118 | A | 5/1980 | Alford |
| 4,253,193 | A | 2/1981 | Kennard |
| 4,305,052 | A | 12/1981 | Baril et al. |
| 4,513,412 | A | 4/1985 | Cox |
| 4,554,554 | A | 11/1985 | Olesen et al. |
| 4,733,203 | A | 3/1988 | Ayasli |
| 4,764,773 | A | 8/1988 | Larsen et al. |
| 4,800,393 | A | 1/1989 | Edward et al. |
| 4,814,777 | A | 3/1989 | Monser |
| 4,821,040 | A | 4/1989 | Johnson et al. |
| 4,920,285 | A | 4/1990 | Clark et al. |
| 4,937,585 | A | 6/1990 | Shoemaker |
| 5,063,574 | A | 11/1991 | Moose |
| 5,097,484 | A | 3/1992 | Akaiwa |
| 5,173,711 | A | 12/1992 | Takeuchi et al. |
| 5,203,010 | A | 4/1993 | Felix |
| 5,208,564 | A | 5/1993 | Burns et al. |
| 5,220,340 | A | 6/1993 | Shafai |
| 5,241,693 | A | 8/1993 | Kim |
| 5,282,222 | A | 1/1994 | Fattouche et al. |
| 5,291,289 | A | 3/1994 | Hulyalkar et al. |
| 5,311,550 | A | 5/1994 | Fouche et al. |
| 5,337,066 | A | 8/1994 | Hirata et al. |
| 5,373,548 | A | 12/1994 | McCarthy |
| 5,434,575 | A | 7/1995 | Jelinek |
| 5,453,752 | A | 9/1995 | Wang et al. |
| 5,479,176 | A | 12/1995 | Zavrel |
| 5,507,035 | A | 4/1996 | Bantz |
| 5,532,708 | A | 7/1996 | Krenz et al. |
| 5,559,800 | A | 9/1996 | Mousseau et al. |
| 5,726,666 | A | 3/1998 | Hoover et al. |
| 5,754,145 | A | 5/1998 | Evans |
| 5,767,755 | A | 6/1998 | Kim et al. |
| 5,767,807 | A | 6/1998 | Prtichett |
| 5,767,809 | A | 6/1998 | Chuang et al. |
| 5,786,793 | A | 7/1998 | Maeda et al. |
| 5,802,312 | A | 9/1998 | Lazaridis et al. |
| 5,828,346 | A | 10/1998 | Park |
| 5,936,595 | A | 8/1999 | Wang |
| 5,964,830 | A | 10/1999 | Durrett |
| 5,966,102 | A | 10/1999 | Runyon |
| 5,990,838 | A | 11/1999 | Burns et al. |
| 6,005,519 | A | 12/1999 | Burns |
| 6,005,525 | A | 12/1999 | Kivela |
| 6,011,450 | A | 1/2000 | Miya |
| 6,023,250 | A | 2/2000 | Cronyn |
| 6,031,503 | A | 2/2000 | Preiss, II et al. |
| 6,034,638 | A | 3/2000 | Thiel et al. |
| 6,046,703 | A | 4/2000 | Wang |
| 6,052,093 | A | 4/2000 | Yao et al. |
| 6,061,025 | A | 5/2000 | Jackson |
| 6,067,053 | A | 5/2000 | Runyon et al. |
| 6,091,364 | A | 7/2000 | Murakami et al. |
| 6,094,177 | A | 7/2000 | Yamamoto |
| 6,097,347 | A | 8/2000 | Duan et al. |
| 6,104,356 | A | 8/2000 | Hikuma et al. |
| 6,169,523 | B1 | 1/2001 | Ploussios |
| 6,249,216 | B1 | 6/2001 | Flick |
| 6,266,528 | B1 | 7/2001 | Farzaneh |
| 6,281,762 | B1 | 8/2001 | Nakao |
| 6,288,682 | B1 | 9/2001 | Thiel et al. |
| 6,292,153 | B1 | 9/2001 | Aiello et al. |
| 6,307,524 | B1 | 10/2001 | Britain |
| 6,317,599 | B1 | 11/2001 | Rappaport et al. |
| 6,323,810 | B1 | 11/2001 | Poilasne et al. |
| 6,326,922 | B1 | 12/2001 | Hegendoerfer |
| 6,326,924 | B1 | 12/2001 | Muramoto et al. |
| 6,337,628 | B2 | 1/2002 | Campana, Jr. |
| 6,337,668 | B1 | 1/2002 | Ito et al. |
| 6,339,404 | B1 | 1/2002 | Johnson |
| 6,345,043 | B1 | 2/2002 | Hsu |
| 6,351,240 | B1 | 2/2002 | Karimullah et al. |
| 6,356,242 | B1 | 3/2002 | Ploussios |
| 6,356,243 | B1 | 3/2002 | Schneider et al. |
| 6,356,905 | B1 | 3/2002 | Gershman et al. |
| 6,366,254 | B1 | 4/2002 | Sivenpiper |
| 6,377,227 | B1 | 4/2002 | Zhu et al. |
| 6,392,610 | B1 | 5/2002 | Braun et al. |
| 6,396,456 | B1 | 5/2002 | Chiang et al. |
| 6,400,329 | B1 | 6/2002 | Barnes |
| 6,404,386 | B1 | 6/2002 | Proctor, Jr. et al. |
| 6,407,719 | B1 | 6/2002 | Ohira et al. |
| RE37,802 | E | 7/2002 | Fattouche et al. |
| 6,414,647 | B1 | 7/2002 | Lee |
| 6,424,311 | B1 | 7/2002 | Tsai et al. |
| 6,442,507 | B1 | 8/2002 | Skidmore et al. |
| 6,445,688 | B1 | 9/2002 | Garces et al. |
| 6,456,242 | B1 | 9/2002 | Crawford |
| 6,476,773 | B2 | 11/2002 | Palmer |
| 6,492,957 | B2 | 12/2002 | Carillo et al. |
| 6,493,679 | B1 | 12/2002 | Rappaport et al. |
| 6,496,083 | B1 | 12/2002 | Kushitani et al. |
| 6,498,589 | B1 | 12/2002 | Horii |
| 6,499,006 | B1 | 12/2002 | Rappaport et al. |
| 6,507,321 | B2 | 1/2003 | Oberschmidt et al. |
| 6,521,422 | B1 | 2/2003 | Hsu |
| 6,531,985 | B1 | 3/2003 | Jones et al. |
| 6,545,643 | B1 | 4/2003 | Sward |
| 6,583,765 | B1 | 6/2003 | Schamberget et al. |
| 6,586,786 | B2 | 7/2003 | Kitazawa et al. |
| 6,593,891 | B2 | 7/2003 | Zhang |
| 6,606,059 | B1 | 8/2003 | Barabash |
| 6,611,230 | B2 | 8/2003 | Phelan |
| 6,621,029 | B2 | 9/2003 | Galmiche |
| 6,625,454 | B1 | 9/2003 | Rappaport et al. |
| 6,633,206 | B1 | 10/2003 | Kato |
| 6,642,889 | B1 | 11/2003 | McGrath |
| 6,642,890 | B1 | 11/2003 | Chen |
| 6,674,459 | B2 | 1/2004 | Ben-Shachar et al. |
| 6,700,546 | B2 | 3/2004 | Benhammou et al. |
| 6,701,522 | B1 | 3/2004 | Rubin et al. |
| 6,724,346 | B2 | 4/2004 | Le Bolzer |
| 6,725,281 | B1 | 4/2004 | Zintel et al. |
| 6,741,219 | B2 | 5/2004 | Shor |
| 6,747,605 | B2 | 6/2004 | Lebaric |
| 6,753,814 | B2 | 6/2004 | Killen et al. |
| 6,757,267 | B1 | 6/2004 | Evans |
| 6,762,723 | B2 | 7/2004 | Nallo et al. |
| 6,774,852 | B2 | 8/2004 | Chiang et al. |
| 6,774,864 | B2 | 8/2004 | Evans |
| 6,779,004 | B1 | 8/2004 | Zintel et al. |
| 6,819,287 | B2 | 11/2004 | Sullivan et al. |
| 6,822,617 | B1 | 11/2004 | Mather et al. |
| 6,839,038 | B2 | 1/2005 | Weinstein |
| 6,859,176 | B2 | 2/2005 | Choi |
| 6,859,182 | B2 | 2/2005 | Horii |
| 6,864,852 | B2 | 3/2005 | Chiang et al. |
| 6,876,280 | B2 | 4/2005 | Nakano |
| 6,876,836 | B2 | 4/2005 | Lin et al. |
| 6,879,293 | B2 | 4/2005 | Sato |

(56) References Cited

U.S. PATENT DOCUMENTS 6,888,504 B2 5/2005 Chiang et al.
6,888,893 B2 5/2005 Li et al.
6,892,230 B1 5/2005 Gu et al.
6,894,653 B2 5/2005 Chiang et al.
6,903,686 B2 6/2005 Vance et al.
6,906,678 B2 6/2005 Chen
6,910,068 B2 6/2005 Zintel et al.
6,914,566 B2 7/2005 Beard
6,914,581 B1 7/2005 Popek
6,924,768 B2 8/2005 Wu et al.
6,931,429 B2 8/2005 Gouge et al.
6,933,907 B2 8/2005 Shirosaka
6,941,143 B2 9/2005 Mathur
6,943,749 B2 9/2005 Paun
6,950,019 B2 9/2005 Bellone et al.
6,950,069 B2 9/2005 Gaucher et al.
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,024,225 B2 4/2006 Ito
7,034,769 B2 4/2006 Surducan et al.
7,034,770 B2 4/2006 Yang et al.
7,043,277 B1 5/2006 Pfister
7,046,201 B2 5/2006 Okada
7,050,809 B2 5/2006 Lim
7,053,844 B2 5/2006 Gaucher et al.
7,064,717 B2 6/2006 Kaluzni
7,085,814 B1 8/2006 Ghandi et al.
7,088,299 B2 8/2006 Siegler et al.
7,088,306 B2 8/2006 Chiang et al.
7,089,307 B2 8/2006 Zintel et al.
7,098,863 B2 8/2006 Bancroft
D530,325 S 10/2006 Kerila
7,120,405 B2 10/2006 Rofougaran
7,130,895 B2 10/2006 Zintel et al.
7,148,846 B2 12/2006 Qi et al.
7,162,273 B1 1/2007 Ambramov et al.
7,164,380 B2 1/2007 Saito
7,171,475 B2 1/2007 Weisman et al.
7,193,562 B2 3/2007 Shtrom
7,206,610 B2 4/2007 Iacono et al.
7,215,296 B2 5/2007 Ambramov et al.
7,277,063 B2 10/2007 Shirosaka et al.
7,292,198 B2 11/2007 Shtrom et al.
7,292,870 B2 11/2007 Heredia et al.
7,295,825 B2 11/2007 Raddant
7,298,228 B2 11/2007 Sievenpiper
7,312,762 B2 12/2007 Puente Ballarda et al.
7,319,432 B2 1/2008 Andersson
7,333,460 B2 2/2008 Vaisanen et al.
7,358,912 B1 4/2008 Kish et al.
7,362,280 B2 4/2008 Shtrom
7,385,563 B2 6/2008 Bishop
7,498,999 B2 3/2009 Shtrom et al.
7,511,680 B2 3/2009 Shtrom et al.
7,522,569 B2 4/2009 Rada
7,525,486 B2 4/2009 Shtrom
7,609,648 B2 10/2009 Hoffmann et al.
7,697,550 B2 4/2010 Rada
7,733,275 B2 6/2010 Hirota
7,782,895 B2 8/2010 Pasanen et al.
7,835,697 B2 11/2010 Wright
7,847,741 B2 12/2010 Hirota
7,864,119 B2 1/2011 Shtrom et al.
7,893,882 B2 2/2011 Shtrom
7,916,463 B2 3/2011 Aya et al.
8,068,068 B2 11/2011 Kish et al.
8,072,388 B2 * 12/2011 Nysen ..... H01Q 1/2258 343/702
8,085,206 B2 12/2011 Shtrom
8,217,843 B2 7/2012 Shtrom
8,355,912 B1 1/2013 Keesey et al.
8,358,248 B2 1/2013 Shtrom
8,686,905 B2 4/2014 Shtrom
8,704,720 B2 4/2014 Kish
8,723,741 B2 5/2014 Shtrom
8,756,668 B2 6/2014 Shtrom
8,836,606 B2 9/2014 Kish
9,019,165 B2 4/2015 Shtrom
9,093,758 B2 7/2015 Kish
2001/0046848 A1 11/2001 Kenkel
2002/0031130 A1 3/2002 Tsuchiya et al.
2002/0036586 A1 3/2002 Gothard et al.
2002/0047800 A1 4/2002 Proctor, Jr. et al.
2002/0080767 A1 6/2002 Lee
2002/0084942 A1 7/2002 Tsai et al.
2002/0101377 A1 8/2002 Crawford
2002/0105471 A1 8/2002 Kojima et al.
2002/0112058 A1 8/2002 Weisman et al.
2002/0113743 A1 * 8/2002 Judd ..... H01Q 1/007 343/757
2002/0119757 A1 8/2002 Hamabe
2002/0158798 A1 10/2002 Chiang et al.
2002/0163473 A1 11/2002 Koyama et al.
2002/0170064 A1 11/2002 Monroe et al.
2003/0026240 A1 2/2003 Eyuboglu et al.
2003/0030588 A1 2/2003 Kalis et al.
2003/0038698 A1 2/2003 Hirayama
2003/0063591 A1 4/2003 Leung et al.
2003/0122714 A1 7/2003 Wannagot et al.
2003/0169330 A1 9/2003 Ben-Shachar et al.
2003/0174099 A1 9/2003 Bauer et al.
2003/0184490 A1 10/2003 Raiman et al.
2003/0184492 A1 10/2003 Chiang et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0214446 A1 11/2003 Shehab
2003/0227414 A1 12/2003 Saliga et al.
2004/0014432 A1 1/2004 Boyle
2004/0017310 A1 1/2004 Vargas-Hurlston et al.
2004/0017315 A1 1/2004 Fang et al.
2004/0017860 A1 1/2004 Liu
2004/0027291 A1 2/2004 Zhang et al.
2004/0027304 A1 2/2004 Chiang et al.
2004/0030900 A1 2/2004 Clark
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0075609 A1 4/2004 Li
2004/0080455 A1 4/2004 Lee
2004/0090371 A1 5/2004 Rossman
2004/0095278 A1 5/2004 Kanemoto et al.
2004/0114535 A1 6/2004 Hoffmann et al.
2004/0125777 A1 7/2004 Doyle et al.
2004/0145528 A1 7/2004 Mukai et al.
2004/0153647 A1 8/2004 Rotholtz et al.
2004/0160376 A1 8/2004 Hornsby et al.
2004/0190477 A1 9/2004 Olson et al.
2004/0203347 A1 10/2004 Nguyen
2004/0207563 A1 10/2004 Yang
2004/0227669 A1 11/2004 Okada
2004/0260800 A1 12/2004 Gu et al.
2005/0022210 A1 1/2005 Zintel et al.
2005/0041739 A1 2/2005 Li et al.
2005/0042988 A1 2/2005 Hoek et al.
2005/0048934 A1 3/2005 Rawnick et al.
2005/0050352 A1 3/2005 Narayanaswami et al.
2005/0062649 A1 3/2005 Chiang et al.
2005/0074018 A1 4/2005 Zintel et al.
2005/0097503 A1 5/2005 Zintel et al.
2005/0122265 A1 6/2005 Gaucher et al.
2005/0128983 A1 6/2005 Kim et al.
2005/0128988 A1 6/2005 Simpson et al.
2005/0135480 A1 6/2005 Li et al.

(56) References Cited

U.S. PATENT DOCUMENTS

| | | | |
|---|---|---|---|
| 2005/0138137 | A1 | 6/2005 | Encarnacion et al. |
| 2005/0138193 | A1 | 6/2005 | Encarnacion et al. |
| 2005/0146475 | A1 | 7/2005 | Bettner et al. |
| 2005/0180381 | A1 | 8/2005 | Retzer et al. |
| 2005/0184920 | A1 | 8/2005 | Mahler et al. |
| 2005/0188193 | A1 | 8/2005 | Kuehnel et al. |
| 2005/0237258 | A1 | 10/2005 | Abramov et al. |
| 2005/0240665 | A1 | 10/2005 | Gu et al. |
| 2005/0267935 | A1 | 12/2005 | Gandhi et al. |
| 2006/0031922 | A1 | 2/2006 | Sakai |
| 2006/0038734 | A1 | 2/2006 | Shtrom et al. |
| 2006/0050005 | A1 | 3/2006 | Shirosaka et al. |
| 2006/0094371 | A1 | 5/2006 | Nguyen |
| 2006/0098607 | A1 | 5/2006 | Zeng et al. |
| 2006/0109191 | A1 | 5/2006 | Shtrom |
| 2006/0111902 | A1 | 5/2006 | Julia et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184660 | A1 | 8/2006 | Rao et al. |
| 2006/0184661 | A1 | 8/2006 | Weisman et al. |
| 2006/0184693 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227062 | A1 | 10/2006 | Francque et al. |
| 2006/0227761 | A1 | 10/2006 | Scott, III et al. |
| 2006/0239369 | A1 | 10/2006 | Lee |
| 2006/0251256 | A1 | 11/2006 | Asokan et al. |
| 2006/0262015 | A1 | 11/2006 | Thornell-Pers et al. |
| 2006/0291434 | A1 | 12/2006 | Gu et al. |
| 2007/0027622 | A1 | 2/2007 | Cleron et al. |
| 2007/0037619 | A1 | 2/2007 | Matsunaga et al. |
| 2007/0055752 | A1 | 3/2007 | Wiegand et al. |
| 2007/0115180 | A1 | 5/2007 | Kish et al. |
| 2007/0124490 | A1 | 5/2007 | Kalavade et al. |
| 2007/0130294 | A1 | 6/2007 | Nishio |
| 2007/0135167 | A1 | 6/2007 | Liu |
| 2008/0060064 | A1 | 3/2008 | Wynn et al. |
| 2008/0062058 | A1 | 3/2008 | Bishop |
| 2008/0075280 | A1 | 3/2008 | Ye et al. |
| 2008/0096492 | A1 | 4/2008 | Yoon |
| 2008/0109657 | A1 | 5/2008 | Bajaj et al. |
| 2008/0136715 | A1 | 6/2008 | Shtrom |
| 2008/0212535 | A1 | 9/2008 | Karaoguz et al. |
| 2008/0272977 | A1 | 11/2008 | Gaucher et al. |
| 2009/0005005 | A1 | 1/2009 | Forstall et al. |
| 2009/0103731 | A1 | 4/2009 | Sarikaya |
| 2009/0187970 | A1 | 7/2009 | Mower et al. |
| 2009/0217048 | A1 | 8/2009 | Smith |
| 2009/0219903 | A1 | 9/2009 | Alamouti et al. |
| 2009/0295648 | A1 | 12/2009 | Dorsey et al. |
| 2009/0315794 | A1 | 12/2009 | Alamouti et al. |
| 2010/0053023 | A1 | 3/2010 | Shtrom |
| 2010/0060529 | A1* | 3/2010 | Schlub ..... H01Q 1/243 343/702 |
| 2010/0103065 | A1 | 4/2010 | Shtrom et al. |
| 2010/0103066 | A1 | 4/2010 | Shtrom et al. |
| 2010/0299518 | A1 | 11/2010 | Viswanathan et al. |
| 2010/0332828 | A1 | 12/2010 | Goto |
| 2011/0007705 | A1 | 1/2011 | Buddhikot et al. |
| 2011/0040870 | A1 | 2/2011 | Wynn et al. |
| 2011/0047603 | A1 | 2/2011 | Gordon et al. |
| 2011/0095960 | A1 | 4/2011 | Shtrom |
| 2011/0126016 | A1 | 5/2011 | Sun |
| 2011/0208866 | A1 | 8/2011 | Marmolejo-Meillon et al. |
| 2012/0030466 | A1 | 2/2012 | Yamaguchi |
| 2012/0054338 | A1 | 3/2012 | Ando |
| 2012/0089845 | A1 | 4/2012 | Raleigh |
| 2012/0098730 | A1 | 4/2012 | Kish |
| 2012/0134291 | A1 | 5/2012 | Raleigh |
| 2012/0257536 | A1 | 10/2012 | Kholaif et al. |
| 2012/0284785 | A1 | 11/2012 | Salkintzis et al. |
| 2012/0299772 | A1 | 11/2012 | Shtrom |
| 2012/0322035 | A1 | 12/2012 | Julia et al. |
| 2013/0007853 | A1 | 1/2013 | Gupta et al. |
| 2013/0038496 | A1 | 2/2013 | Shtrom |
| 2013/0047218 | A1 | 2/2013 | Smith |
| 2013/0182693 | A1 | 7/2013 | Sperling et al. |
| 2013/0207865 | A1 | 8/2013 | Shtrom |
| 2013/0207866 | A1 | 8/2013 | Shtrom |
| 2013/0207877 | A1 | 8/2013 | Shtrom |
| 2013/0212656 | A1 | 8/2013 | Shtrom |
| 2013/0241789 | A1 | 9/2013 | Shtrom |
| 2013/0269008 | A1 | 10/2013 | Shtrom |
| 2014/0282951 | A1 | 9/2014 | Ranade |
| 2014/0334322 | A1 | 11/2014 | Shtrom |
| 2015/0070243 | A1 | 3/2015 | Kish |

FOREIGN PATENT DOCUMENTS

| | | |
|---|---|---|
| DE | 10 2006 02635 | 12/2006 |
| EP | 0 352 787 | 1/1990 |
| EP | 0 534 612 | 3/1993 |
| EP | 0 756 381 | 1/1997 |
| EP | 0 883 206 | 12/1998 |
| EP | 1 152 452 | 11/2001 |
| EP | 1 152 543 | 11/2001 |
| EP | 1 376 920 | 6/2002 |
| EP | 1 220 461 | 7/2002 |
| EP | 1 315 311 | 5/2003 |
| EP | 1 450 521 | 8/2004 |
| EP | 1 608 108 | 12/2005 |
| EP | 1 909 358 | 4/2008 |
| EP | 1 287 588 | 1/2009 |
| GB | 2 426 870 | 6/2006 |
| GB | 2 423 191 | 8/2006 |
| JP | 03038933 | 2/1991 |
| JP | 08-088633 | 4/1996 |
| JP | 2001-057560 | 2/2001 |
| JP | 2002-505835 | 2/2002 |
| JP | 2005-354249 | 12/2005 |
| JP | 2006-060408 | 3/2006 |
| TW | 201351188 | 12/2013 |
| WO | WO 90/04893 | 5/1990 |
| WO | WO 99/55012 | 10/1999 |
| WO | WO 01/13461 | 2/2001 |
| WO | WO 01/69724 | 9/2001 |
| WO | WO 02/07258 A2 | 1/2002 |
| WO | WO 02/07258 A3 | 1/2002 |
| WO | WO 02/25967 | 3/2002 |
| WO | WO 03/079484 | 9/2003 |
| WO | WO 2003/081718 | 10/2003 |
| WO | WO 2004/051798 | 6/2004 |
| WO | WO 2006/023247 | 3/2006 |
| WO | WO 2006/057679 | 6/2006 |
| WO | WO 2007/076105 | 7/2007 |
| WO | WO 2007/127087 | 11/2007 |
| WO | WO 2013/119750 | 8/2013 |
| WO | WO 2013/152027 | 10/2013 |

OTHER PUBLICATIONS

Google, "Hotspots pre-shared keys". Date of download: Nov. 24, 2014.

IEEE Xplore Digital Library "Hotspots shared keys". Date of download: Nov. 24, 2014.

PCT Application No. PCT/US2013/34997, Written Opinion dated Jun. 17, 2013 (Date of Online Publication: Oct. 4, 2014), 6 pages.

Abramov 2003—P.R. 3-3© Chart for U.S. Pat. No. 7,525,486 and U.S. Pat. No. 7,193,562, 68 pages.

Abramov 273—P.R. 3-3© Chart for U.S. Pat. No. 7,525,486 and U.S. Pat. No. 7,193,562, 31 pages.

Abramov 296—P.R. 3-3© Chart for U.S. Pat. No. 7,525,486 and U.S. Pat. No. 7,193,562, 34 pages.

Airgain 2004—P.R. 3-3© Chart for U.S. Pat. No. 7,525,486 and U.S. Pat. No. 7,193,562, 24 pages.

Akyildiz, Ian F. et al., "A Virtual Topology Based Routing Protocol for Multihop Dynamic Wireless Networks," Wireless Networks 7, Kluwer Academic Publishers, 2001, pp. 413-424.

(56) References Cited

OTHER PUBLICATIONS

Alard, M., et al., "Principles of Modulation and Channel Coding for Digital Broadcasting for Mobile Receivers," 8301 EBU Review Technical, No. 224, Brussels, Belgium, Aug. 1987, 23 pages.
Alimian, Areg, et al., "Analysis of Roaming Techniques," Doc. :IEEE 802.11-04/0377r1, Submission, Mar. 2004, 24 pages.
Ando et al., "Study of Dual-Polarized Omni-Directional Antennas for 5.2 GHz-Band 2x2 MIMO-OFDM Systems," Antennas and Propagation Society International Symposium, vol. 2, IEEE, Jun. 2004, pp. 1740-1743.
"Authorization of Spread Spectrum Systems Under Parts 15 and 90 of the FCC Rules and Regulations," Rules and Regulations Federal Communications Commission, 47 CFR Parts 2, 15, and 90, Jun. 18, 1985, 10 pages.
"Authorization of Spread Spectrum and Other Wideband Emissions Not Presently Provided for in the FCC Rules and Regulations," Notice of Inquiry, Before the Federal Communications Commission, FCC 81-289, 87 F.C.C.2d 876, Gen Docket No. 81-413, Jun. 30, 1981, 9 pages.
Bancroft 863—P.R. 3-3© Chart for U.S. Pat. No. 7,525,486 and U.S. Pat. No. 7,193,562, 28 pages.
Barabash 059—P.R. 3-3© Chart for U.S. Pat. No. 7,525,486 and U.S. Pat. No. 7,193,562, 50 pages.
Bargh et al., "Fast Authentication Methods for Handovers between IEEE 802.11 Wireless LANs", Proceedings of the ACM International Workshop on Wireless Mobile Applications and Services on WLAN Hotspots. Oct. 1, 2004. pp. 51-60.
Bedell, Paul, Wireless Crash Course, Second Edition, Chapter 5, Appendix U, The McGraw-Hill Companies, Inc., 2005, p. 84.
Behdad et al., "Slot Antenna Miniaturization Using Distributed Inductive Loading", Antennas and Propagation Society International Symposium, IEEE, vol. 1, 2003, pp. 308-311.
Berenguer, Inaki, et al., "Adaptive MIMO Antenna Selection," Nov. 2003, 6 pages.
Calhoun, Pat et al., "802.11r strengthens wireless voice," Technology Update, Network World, Aug. 22, 2005, http://www.networkworld.com/news/tech/2005/082208techupdate.html, 2 pages.
Casas, Eduardo F., et al., "OFDM for Data Communication Over Mobile Radio FM Channels—Part I: Analysis and Experimental Results," IEEE Transactions on Communications, vol. 39, No. 5, May 1991, pp. 783-793.
Casas, Eduardo F., et al., "OFDM for Data Communication Over Mobile Radio FM Channels; Part II: Performance Improvement," IEEE Transactions on Communications, vol. 40, No. 4, 1992, pp. 680-683.
Cetiner 2003—P.R. 3-3© Chart for U.S. Pat. No. 7,525,486 and U.S. Pat. No. 7,193,562, 27 pages.
Chang, Nicholas B. et al., "Optimal Channel Probing and Transmission Scheduling for Opportunistic Spectrum Access," MobiCom '07, Sep. 2007, 12 pages.
Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Chang, Robert W., "Synthesis of Band-Limited Orthogonal Signals for Multichannel Data Transmission," The Bell System Technical Journal, Dec. 1966, pp. 1775-1796.
Chuang 2003—P.R. 3-3© Chart for U.S. Pat. No. 7,525,486 and U.S. Pat. No. 7,193,562, 52 pages.
Chuang et al., A 2.4 GHz Polarization-diversity Planar Printed Dipole Antenna for WLAN and Wireless Communication Applications, Microwave Journal, vol. 45, No. 6, Jun. 2002, pp. 50-62.
Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.
Cisco Systems, "Cisco Aironet Access Point Software Configuration Guide: Configuring Filters and Quality of Service," Aug. 2003, 25 pages.
Dell Inc., "How Much Broadcast and Multicast Traffic Should I Allow in My Network," PowerConnect Application Note #5, Nov. 2003, 6 pages.
Dutta, Ashutosh et al., "MarconiNet Supporting Streaming Media Over Localized Wireless Multicast," WMC '02 Proceedings of the 2nd international workshop on Mobile commerce, 2002, pp. 61-69.
Dunkels, Adam et al., "Making TCP/IP Viable for Wireless Sensor Networks," Proc. of the 1st Euro. Workshop on Wireless Sensor Networks, Berlin, Jan. 2004.
Dunkels, Adam et al., "Connecting Wireless Sensornets with TCP/IP Networks," Proc. of the 2d Int'l Conf. on Wired Networks, Frankfurt, Feb. 2004.
Encrypted Preshared key; Cisco Systems, Inc., 2010, 14 pages.
English Translation of PCT Pub. No. WO2004/051798 (as filed US National Stage U.S. Appl. No. 10/536,547 on May 26, 2005), 25 pages.
Evans '864—P.R. 3-3© Chart for U.S. Pat. No. 7,525,486, 8 pages.
Festag, Andreas, "What is MOMBASA?" Telecommunication Networks Group (TKN), Technical University of Berlin, Mar. 7, 2002, 5 pages.
Frederick et al., "Smart Antennas Based on Spatial Multiplexing of Local Elements (SMILE) for Mutual Coupling Reduction", IEEE Transactions of Antennas and Propagation, vol. 52., No. 1, Jan. 2004, pp. 106-114.
Gaur, Sudhanshu, et al., "Transmit/Receive Antenna Selection for MIMO Systems to Improve Error Performance of Linear Receivers," School of ECE, Georgia Institute of Technology, Apr. 4, 2005, 8 pages.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Golmie, Nada, "Coexistence in Wireless Networks: Challenges and System-Level Solutions in the Unlicensed Bands," Cambridge University Press, 2006, 15 pages.
Hewlett-Packard, "HP ProCurve Networking: Enterprise Wireless LAN Networking and Mobility Solutions," Hewlett-Packard Company, 2003, 8 pages.
Hirayama, Koji et al., "Next-Generation Mobile-Access IP Network," Hitachi Review vol. 49, No. 4, 2000, pp. 176-179.
Information Society Technologies Ultrawaves, "D1:1 System Concept/Architecture Design and Communication Stack Requirement Document," IST Ultrawaves, Feb. 23, 2004, 97 pages.
Johnson 404—P.R. 3-3© Chart for U.S. Pat. No. 7,525,486 and U.S. Pat. No. 7,193,562, 18 pages.
Kalis 2000—P.R. 3-3© Chart for U.S. Pat. No. 7,525,486 and U.S. Pat. No. 7,193,562, 17 pages.
Kalis 2002—P.R. 3-3© Chart for U.S. Pat. No. 7,525,486, 12 pages.
Kaluzni 717—P.R. 3-3© Chart for U.S. Pat. No. 7,525,486 and U.S. Pat. No. 7,193,562, 15 pages.
Kassab et al., "Fast Pre-Authentication Based on Proactive Key Distribution for 802.11 Infrastructure Networks", WMuNeP'05, Oct. 13, 2005, Montreal, Quebec, Canada, Copyright 2005 ACM, pp. 46-53.
Kim 693—P.R. 3-3© Chart for U.S. Pat. No. 7,525,486 and U.S. Pat. No. 7,193,562, 23 pages.
Lin 836—P.R. 3-3© Chart for U.S. Pat. No. 7,525,486 and U.S. Pat. No. 7,193,562, 25 pages.
Mawa, Rakesh, "Power Control in 3G Systems," Hughes Systique Corporation, Jun. 28, 2006, 6 pages.
Microsoft Corporation, "IEEE 802.11 Networks and Windows XP," Windows Hardware Developer Central, Dec. 4, 2001, 8 pages.
Miller, RL, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Molisch, Andreas F., et al., "MIMO Systems with Antenna Selection—an Overview," Mitsubishi Electric Research Labs (MERL), Draft, Dec. 31, 2003, 19 pages.

(56) References Cited

OTHER PUBLICATIONS

Moose, Paul H., "Differential Modulation and Demodulation of Multi-Frequency Digital Communications Signals," IEEE Conference on Military Communications (MILCOM '90), 1990, pp. 0273-0277.
Nakao 762—P.R. 3-3© Chart for U.S. Pat. No. 7,525,486, 12 pages.
Okada 201—P.R. 3-3© Chart for U.S. Pat. No. 7,525,486 and U.S. Pat. No. 7,193,562, 23 pages.
Orinoco AP-2000 5GHz Kit, "Access Point Family," Proxim Corporation, 2003, 2 pages.
Palmer 773—P.R. 3-3© Chart for U.S. Pat. No. 7,525,486 and U.S. Pat. No. 7,193,562, 36 pages.
Park, Vincent D., et al., "A Performance Comparison of the Temporally-Ordered Routing Algorithm and Ideal Link-State Routing," IEEE Proceedings of ISCC '98, Athens, Greece, Jun. 30-Jul. 2, 1998, 7 pages.
Paun 749—P.R. 3-3© Chart for U.S. Pat. No. 7,525,486 and U.S. Pat. No. 7,193,562, 13 pages.
"NETGEAR RangeMax™ Wireless Networking Solutions Incorporate Smart MIMO Technology to Eliminate Wireless Dead Spots and Take Consumers Farther", Ruckus Wireles Inc. Press Release, Mar. 7, 2005, available at http://ruckuswireless.com/press/releases/20050307.php., (accessed on Apr. 10, 2018), 2 pages.
Qian 2000—P.R. 3-3© Chart for U.S. Pat. No. 7,525,486 and U.S. Pat. No. 7,193,562, 16 pages.
Request for Inter Partes Reexamination for U.S. Pat. No. 7,358,912, filed by Rayspan Corporation and Netgear, Inc., Sep. 4, 2008, 48 pages.
Defendant Netgear, Inc.'s Invalidity Contentions, *Ruckus Wireless, Inc.* v. *Netgear, Inc.*, N. D. California Case No. C08-2310-PJH; 17 pages.
Sadek, Mirette, et al., "Active Antenna Selection in Multiuser MIMO Communications," IEEE Transactions on Signal Processing, vol. 55, No. 4, Apr. 2007, pp. 1498-1510.
Saltzberg, Burton R., "Performance of an Efficient Parallel Data Transmission System," IEEE Transactions on Communication Technology, vol. Com-15, No. 6, Dec. 1967, pp. 805-811.
Shehab 2003—P.R. 3-3© Chart for U.S. Pat. No. 7,525,486 and U.S. Pat. No. 7,193,562, 35 pages.
Shirosaka 907—P.R. 3-3© Chart for U.S. Pat. No. 7,525,486 and U.S. Pat. No. 7,193,562, 43 pages.
Shtrom 198 & 280—P.R. 3-3© Chart for U.S. Pat. No. 7,525,486 and U.S. Pat. No. 7,193,562, 36 pages.
Sievenpiper 254—P.R. 3-3© Chart for U.S. Pat. No. 7,525,486 and U.S. Pat. No. 7,193,562, 41 pages.
Simons 1994—P.R. 3-3© Chart for U.S. Pat. No. 7,525,486 and U.S. Pat. No. 7,193,562, 19 pages.
Steger, Christopher et al., "Performance of IEEE 802.11b Wireless LAN in an Emulated Mobile Channel," Department of Electrical and Computer Engineering, Rice University, Houston, Texas, 2003, 5 pages.
Sward 643—P.R. 3-3© Chart for U.S. Pat. No. 7,525,486 and U.S. Pat. No. 7,193,562, 16 pages.
Tang, Ken et al., "MAC Layer Broadcast Support in 802.11 Wireless Networks," Computer Science Department, University of California, Los Angeles, IEEE, 2000, pp. 544-548.
Tang, Ken et al., "MAC Reliable Broadcast in Ad Hoc Networks," Computer Science Department, University of California, Los Angeles, IEEE, 2001, pp. 1008-1013.
Toskala, Antti, "Presentation on Proposed WI: Enhancement of Broadcast and Introduction of Multicast Capabilities in RAN," Nokia Networks, Palm Springs, California, Mar. 13-16, 2001, 8 pages.
Tsunekawa, Kouichi, "Diversity Antennas for Portable Telephones," 39th IEEE Vehicular Technology Conference, vol. I, Gateway to New Concepts in Vehicular Technology, San Francisco, CA, May 1-3, 1989, pp. 50-56.
Varnes et al., "A Switched Radial Divider for an L-Band Mobile Satellite Antenna", European Microwave Conference, Oct. 1995, pp. 1037-1041.
Vaughan 1995—P.R. 3-3© Chart for U.S. Pat. No. 7,525,486 and U.S. Pat. No. 7,193,562, 19 pages.
Wang 703—P.R. 3-3© Chart for U.S. Pat. No. 7,525,486 and U.S. Pat. No. 7,193,562, 21 pages.
W.E. Doherty, Jr. et al., "The Pin Diode Circuit Designer's Handbook", Microsemi Corporation, 1998, 136 pages.
Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.
Wennström, Mattias et al., "Transmit Antenna Diversity in Ricean Fading MIMO Channels with Co-Channel Interference," Signals and Systems Group, Uppsala University, 2001, 5 pages.
Petition Decision Denying Request to Order Additional Claims for U.S. Pat. No. 7,193,562 (Control No. 95/001078) dated Jul. 10, 2009, 10 pages.
Right of Appeal Notice for U.S. Pat. No. 7,193,562 (Control No. 95/001078) dated Jul. 10, 2009, 19 pages.
Third Party Comments after Patent Owner's Response in Accordance with 37 CFR 1.947 for U.S. Pat. No. 7,358,912 (Control No. 95/001079) dated Jun. 17, 2009, 53 pages.
U.S. Appl. No. 95/001,078, dated Sep. 4, 2008, Shtrom et al. (Re-Exam), 141 pages. (Uploaded in 2 Parts).
U.S. Appl. No. 95/001,079, dated Sep. 4, 2008, Shtrom et al. (Re-Exam), 48 pages.
Supplementary European Search Report for EP Application No. EP 05776697.4, dated Jun. 18, 2009, 6 pages.
Extended European Search Report for EP Application No. EP 07755519.1, dated Mar. 9, 2011.
PCT Application No. PCT/US2005/027169, International Search Report and Written Opinion dated Aug. 10, 2006, 8 pages.
PCT Application No. PCT/US2005/27023, International Search Report and Written Opinion dated Dec. 23, 2005, 7 pages.
PCT Application No. PCT/US2006/49211, International Search Report and Written Opinion dated Aug. 29, 2008, 7 pages.
PCT Application No. PCT/US2007/09276, International Search Report and Written Opinion dated Aug. 11, 2008.
PCT Application No. PCT/US2013/34997, International Search Report dated Jun. 17, 2013, 1 page.

* cited by examiner

PATTERN SHAPING OF RF EMISSION PATTERNS

CROSS-REFERENCE TO RELATED APPLICATIONS

The present application is a continuation and claims the priority benefit of U.S. patent application Ser. No. 14/242,689 filed Apr. 1, 2014, which is a continuation and claims the priority benefit of U.S. patent application Ser. No. 13/731,273 filed Dec. 31, 2012, now U.S. Pat. No. 8,686,905, which is a continuation and claims the priority benefit of U.S. patent application Ser. No. 13/305,609 filed Nov. 28, 2011, now U.S. Pat. No. 8,358,248, which is a continuation and claims the priority benefit of U.S. patent application Ser. No. 12/953,324 filed Nov. 23, 2010, now U.S. Pat. No. 8,085,206, which is a continuation and claims the priority benefit of U.S. patent application Ser. No. 11/971,210 filed Jan. 8, 2008, now U.S. Pat. No. 7,893,882, which claims the priority benefit of U.S. provisional application 60/883,962 filed Jan. 8, 2007. The disclosure of each of the aforementioned applications is incorporated herein by reference.

The present application is related to U.S. patent application Ser. No. 11/938,240 filed Nov. 9, 2007 and U.S. patent application Ser. No. 11/041,145 filed Jan. 21, 2005. The disclosure of each of the aforementioned applications is incorporated herein by reference.

BACKGROUND OF THE INVENTION

Field of the Invention

The present invention generally relates to wireless communications and more particularly to changing radio frequency (RF) emission patterns with respect to one or more antenna arrays.

Description of the Related Art

In wireless communications systems, there is an ever-increasing demand for higher data throughput and a corresponding drive to reduce interference that can disrupt data communications. For example, a wireless link in an Institute of Electrical and Electronic Engineers (IEEE) 802.11 network may be susceptible to interference from other access points and stations, other radio transmitting devices, and changes or disturbances in the wireless link environment between an access point and remote receiving node. In some instances, the interference may degrade the wireless link thereby forcing communication at a lower data rate. The interference may, however, be sufficiently strong as to disrupt the wireless link altogether.

One solution is to utilize a diversity antenna scheme. In such a solution, a data source is coupled to two or more physically separated omnidirectional antennas. An access point may select one of the omnidirectional antennas by which to maintain a wireless link. Because of the separation between the omnidirectional antennas, each antenna experiences a different signal environment and corresponding interference level with respect to the wireless link. A switching network couples the data source to whichever of the omnidirectional antennas experiences the least interference in the wireless link.

Notwithstanding, many high-gain antenna environments still encounter—or cause—electromagnetic interference (EMI). This interference may be encountered (or created) with respect to another nearby wireless environments (e.g., between the floors of an office building or hot spots scattered amongst a single room). In some instances, the mere operation of a power supply or electronic equipment—not necessarily an antenna—can create electromagnetic interference.

One solution to combat electromagnetic interference is to utilize shielding in or proximate an antenna enclosure. Shielding a metallic enclosure is imperfect, however, because the conductivity of all metals is finite. Because metallic shields have less than infinite conductivity, part of the field is transmitted across the boundary and supports a current in the metal. The amount of current flow at any depth in the shield and the rate of decay are governed by the conductivity of the metal, its permeability, and the frequency and amplitude of the field source.

A gap or seam in a shield will allow electromagnetic fields to radiate through the shield unless the current continuity can be preserved across the gaps. An EMI gasket is, therefore, often used to preserve continuity or current flow in the shield. If a gasket is made of material identical to the walls of the shielded enclosure, the current density in the gasket will be the same. An EMI gasket fails to allow for shaping of RF patterns and gain control as the gasket is implemented to seal openings in an enclosure as to prevent transmission of EMI.

SUMMARY OF THE CLAIMED INVENTION

In a first claimed embodiment, an antenna system is disclosed which includes an antenna array. The antenna array includes a plurality of antenna elements for selective coupling to a radio frequency feed port. At least two of the plurality of antenna elements generate an omnidirectional radiation pattern having less directionality than a directional radiation pattern of a single antenna element when selectively coupled to the radio frequency feed port. The antenna system further includes an electrically conductive shaping element located proximate the antenna array. The electrically conductive shaping element changes the omnidirectional radiation pattern generated by the at least two of the antenna elements when selectively coupled to the radio frequency feed port.

DETAILED DESCRIPTION

Figure 1:
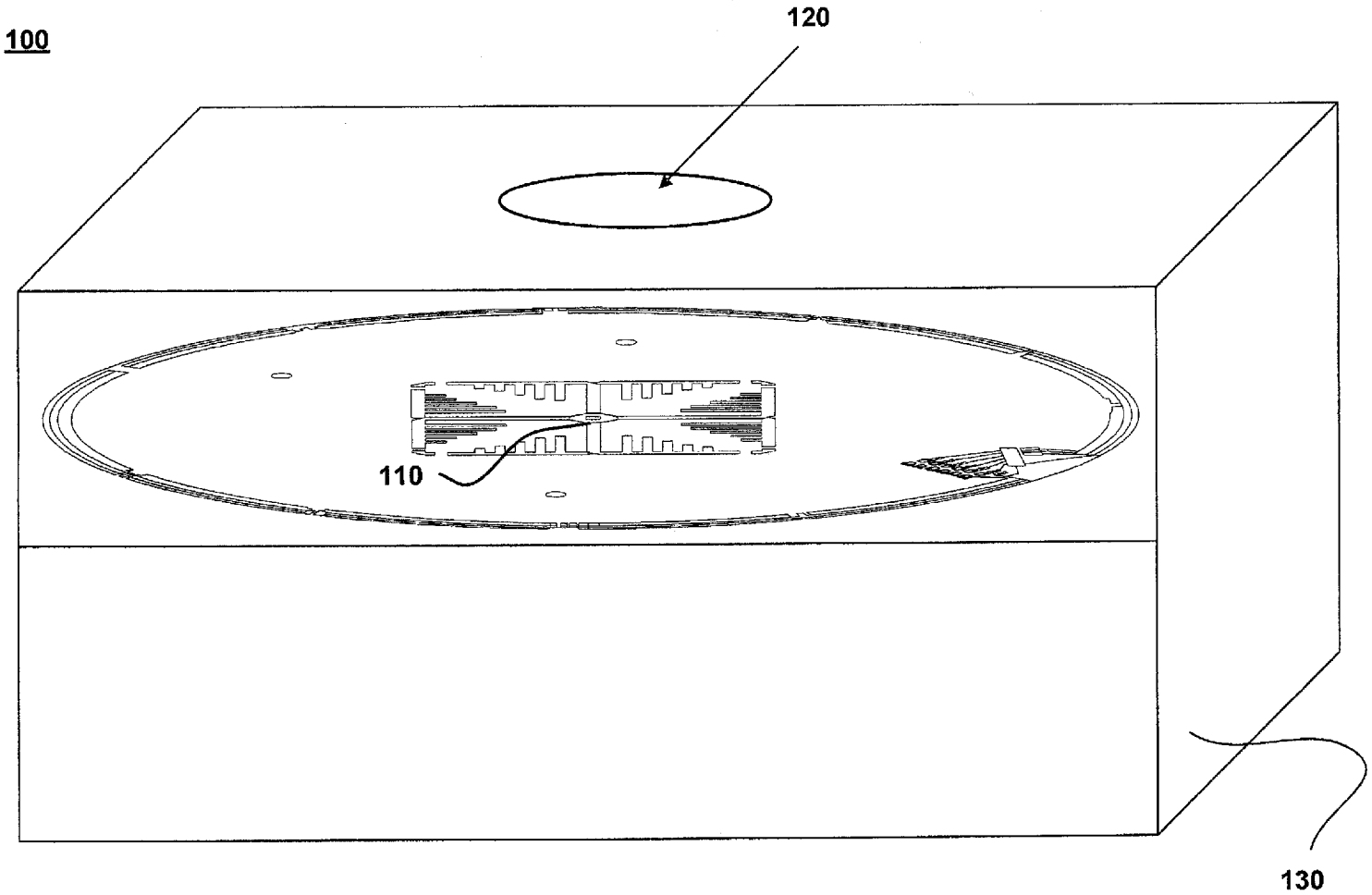
FIG. 1 illustrates a wireless device including a horizontal antenna array and a substantially circular metallic shaping plate effectuating a change in a radiation pattern emitted by the horizontal antenna array.

FIG. 1 illustrates a wireless device 100 including a horizontal antenna array 110 and a substantially circular metallic shaping plate 120 for effectuating a change in a radiation pattern emitted by the horizontal antenna array 110.

The horizontal array 110 of FIG. 1 may include a plurality of antenna elements coupled to a radio frequency feed port. Selectively coupling two or more of the antenna elements to the radio frequency feed port may generate a substantially omnidirectional radiation pattern having less directionality than the directional radiation pattern of a single antenna element. The substantially omnidirectional radiation pattern may be substantially in the plane of the horizontal antenna array.

In some embodiments, the horizontal antenna array may include multiple selectively coupled directors configured to cause a change in the substantially omnidirectional radiation pattern generated by the horizontal antenna array. In such an embodiment, the antenna elements may be permanently coupled to a radio frequency feed port. The directors, however, may be configured such that the effective length of the directors may change through selective coupling of one or more directors to one another.

For example, a series of interrupted and individual directors that are 0.1 cm in length may be selectively coupled in a manner similar to the selective coupling of the aforementioned antenna elements. By coupling together three of the aforementioned 0.1 cm directors, the directors may effectively become reflectors that reflect and otherwise shape the RF pattern emitted by the active antenna elements. RF energy emitted by an antenna array may be focused through these reflectors (and/or directors) to address particular nuances of a given wireless environment. Similar selectively coupled directors may operate with respect to a metallic shaping plate as is further discussed below.

While a horizontal antenna array (110) has been referenced, vertical or off-axis antenna arrays may also be implemented in the practice of the present invention. Likewise, multiple polarization antennas (e.g., an antenna system comprising a two horizontal and a single vertical antenna array) may be used in the practice of the present invention.

In FIG. 1, the horizontal antenna array 110 is enclosed within housing 130. The size and configuration of the housing 130 may vary depending on the exact nature of the wireless device the housing 130 encompasses. For example, the housing 130 may correspond to that of a wireless router that creates a wireless network via a broadband connection in a home or office. The housing 130 may, alternatively, correspond to a wireless access point like that of U.S. design patent application No. 29/292,091. The physical housing of these devices may be a light-weight plastic that offer protection and ventilation to components located inside. The housing of the wireless device may, however, be constructed of any material subject to the whims of the particular manufacturer.

FIG. 1 also illustrates a metallic shaping plate 120 coupled to the interior of the housing 130. In FIG. 1, the metallic shaping plate 120 is substantially centered with respect to the central, vertical axis of the horizontal antenna array 110. The static position of the metallic shaping plate 120 causes a change in the substantially omnidirectional radiation pattern generated by the horizontal antenna array 110.

The metallic shaping plate 120 effectuates such a change in the radiation pattern by 'flattening' the radiation pattern emitted by the antenna array 110. By flattening the pattern, the gain of the generated radiation pattern is increased. The tilt of the radiation pattern may also be influenced by, for example, the specific composition, thickness or shape of the plate 120. In FIG. 1, the plate 120 is substantially circular and uniform in thickness and manufacture. In other embodiments, the shape, thickness and material used in manufacture may differ throughout the plate.

In some embodiments, the metallic shaping plate 120 may be coupled to or operate in conjunction with a series of selectively coupled directors. The metallic shaping plate 120 and selectively coupled directors may be collectively configured to cause a change in the radiation pattern generated by the horizontal antenna array 110. The selective coupling of the directors may be similar to the coupling utilized with respect to directors located on the array 110.

The metallic shaping plate 120 may be coupled to the interior of the housing 130 using a permanent adhesive. In such an embodiment, removal of the plate 120—be it intentional or accidental—may require reapplication of an adhesive to the plate 120 and the housing 130 interior. The plate 120 may also be coupled using a reusable adhesive or other fastener (e.g., Velcro®) such that the plate 120 may be easily removed and reapplied.

Figure 2A:
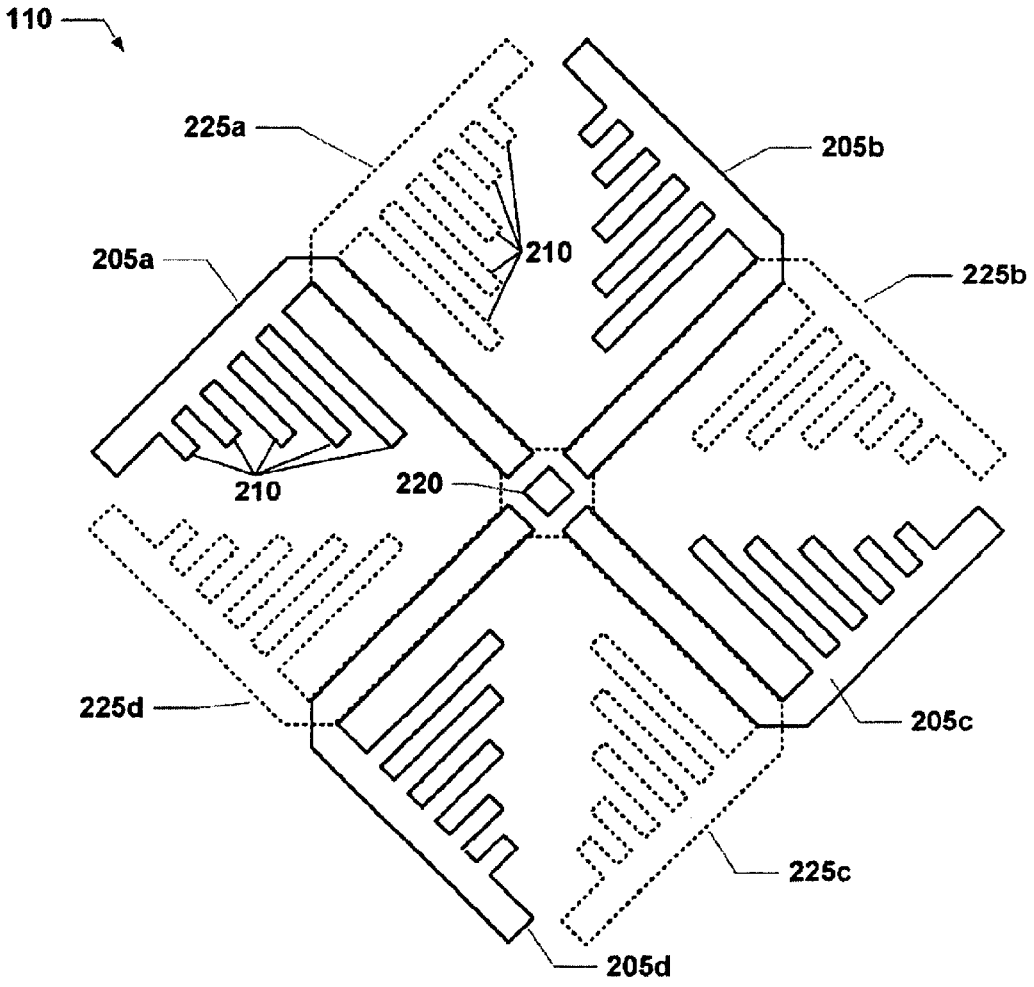
FIG. 2A illustrates a horizontally polarized antenna array with selectable elements as may be may be implemented in a wireless device like that described in FIG. 1.

FIG. 2A illustrates the antenna array 110 of FIG. 1 in one embodiment of the present invention. The antenna array 110 of this embodiment includes a substrate (considered as the plane of FIG. 2A) having a first side (depicted as solid lines 205) and a second side (depicted as dashed lines 225) substantially parallel to the first side. In some embodiments, the substrate includes a printed circuit board (PCB) such as FR4, Rogers 4003, or other dielectric material.

On the first side of the substrate, depicted by solid lines, the antenna array 110 of FIG. 2A includes a radio frequency feed port 220 and four antenna elements 205*a*-205*d*. Although four modified dipoles (i.e., antenna elements) are depicted, more or fewer antenna elements may be implemented. Although the antenna elements 205*a*-205*d* of FIG. 2A are oriented substantially to edges of a square shaped substrate so as to minimize the size of the antenna array 110, other configurations may be implemented. Further, although the antenna elements 205*a*-205*d* form a radially symmetrical layout about the radio frequency feed port 220, a number of non-symmetrical layouts, rectangular layouts, and layouts symmetrical in only one axis may be implemented. Furthermore, the antenna elements 205*a*-205*d* need not be of identical dimension, although depicted as such in FIG. 2A.

On the second side of the substrate, depicted as dashed lines in FIG. 2A, the antenna array 110 includes a ground component 225. It will be appreciated that a portion (e.g., the portion 225*a*) of the ground component 225 is configured to form a modified dipole in conjunction with the antenna element 205*a*. The dipole is completed for each of the antenna elements 205*a*-205*d* by respective conductive traces 225*a*-225*d* extending in mutually-opposite directions. The resultant modified dipole provides a horizontally polarized directional radiation pattern (i.e., substantially in the plane of the antenna array 110).

To minimize or reduce the size of the antenna array 110, each of the modified dipoles (e.g., the antenna element 205*a* and the portion 225*a* of the ground component 225) may incorporate one or more loading structures 210. For clarity of illustration, only the loading structures 210 for the modified dipole formed from the antenna element 205*a* and the portion 225*a* are numbered in FIG. 2A. The loading structure 210 is configured to slow down electrons, changing the resonance of each modified dipole, thereby making the modified dipole electrically shorter. At a given operating frequency, providing the loading structures 210 allows the dimension of the modified dipole to be reduced. Providing the loading structures 210 for all of the modified dipoles of the antenna array 110 minimizes the size of the antenna array 110.

Figure 2B:
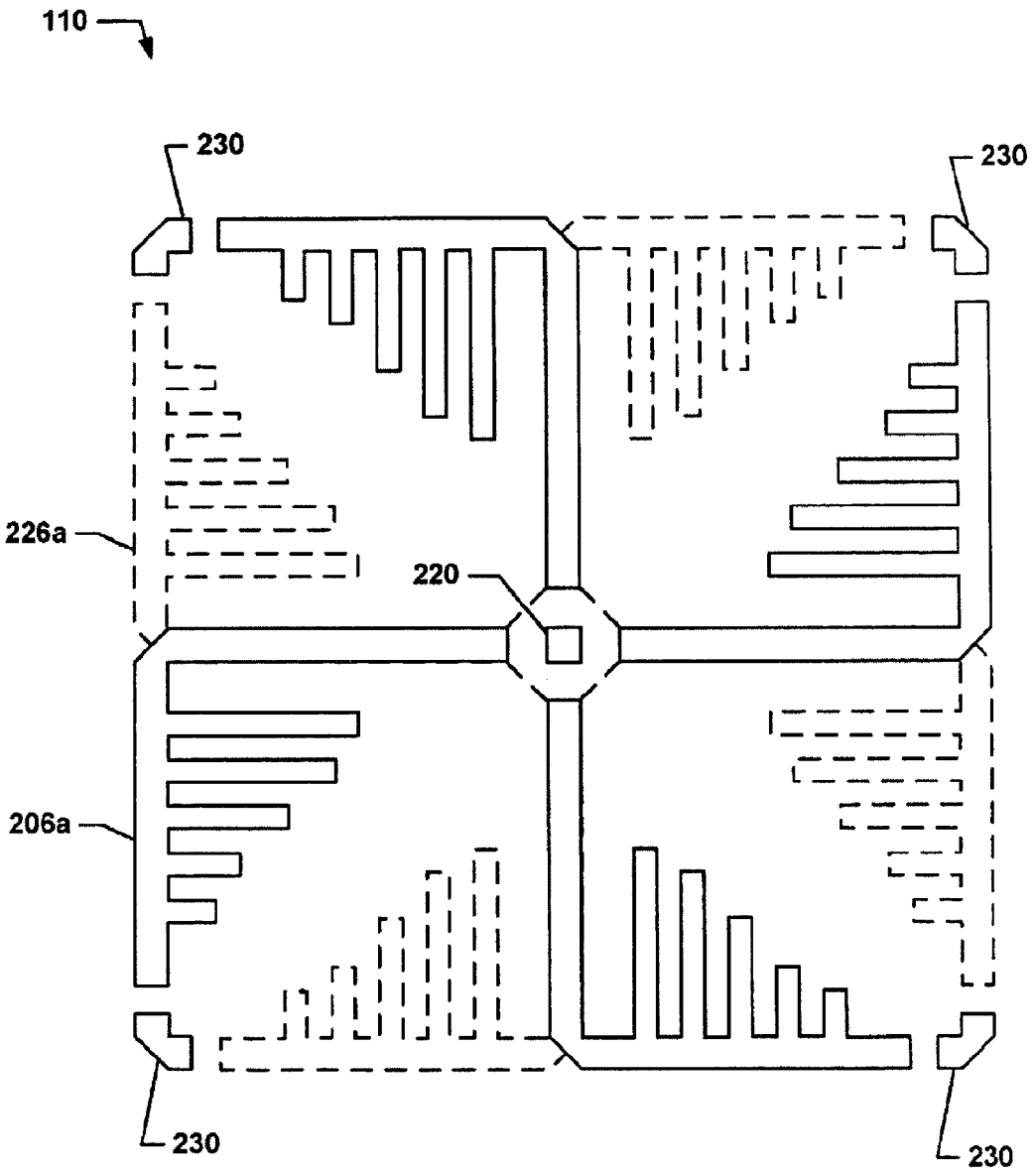
FIG. 2B illustrates an alternative embodiment of a horizontally polarized antenna array with selectable elements as may be implemented in a wireless device like that described in FIG. 1.

FIG. 2B illustrates an alternative embodiment of the antenna array 110 of FIG. 1. The antenna array 110 of this embodiment includes one or more directors 230. The directors 230 include passive elements that constrain the directional radiation pattern of the modified dipoles formed by antenna elements 206*a*-206*d* in conjunction with portions 226*a*-226*d* of the ground component (for clarity, only 206*a* and 226*a* labeled). Because of the directors 230, the antenna elements 206 and the portions 226 are slightly different in configuration than the antenna elements 205 and portions 225 of FIG. 2A. Directors 230 may be placed on either side of the substrate. Additional directors (not shown) may also be included to further constrain the directional radiation pattern of one or more of the modified dipoles.

The radio frequency feed port 220 of FIGS. 2A and 2B is configured to receive an RF signal from an RF generating device such as a radio. An antenna element selector (not shown) may be used to couple the radio frequency feed port 220 to one or more of the antenna elements 205. The antenna element selector may comprise an RF switch such as a PIN diode, a GaAs FET, or virtually any RF switching device.

An antenna element selector, as may be implemented in the context of FIG. 2A, may includes four PIN diodes, each PIN diode connecting one of the antenna elements 205*a*-205*d* to the radio frequency feed port 220. In such an embodiment, the PIN diode may include a single-pole single-throw switch to switch each antenna element either on or off (i.e., couple or decouple each of the antenna elements 205*a*-205*d* to the radio frequency feed port 220). A series of control signals may be used to bias each PIN diode. With the PIN diode forward biased and conducting a DC current, the PIN diode switch is on, and the corresponding antenna element is selected. With the diode reverse biased, the PIN diode switch is off.

In the case of FIG. 2A, the radio frequency feed port 220 and the PIN diodes of the antenna element selector may both be on the side of the substrate with the antenna elements 205*a*-205*d*. Other embodiments, however, may separate the radio frequency feed port 220, the antenna element selector, and the antenna elements 205*a*-205*d*. One or more light emitting diodes (not shown) may be coupled to the antenna element selector as a visual indicator of which of the antenna elements 205*a*-205*d* is on or off. A light emitting diode may be placed in circuit with the PIN diode so that the light emitting diode is lit when the corresponding antenna element 205 is selected.

The antenna components (e.g., the antenna elements 205*a*-205*d*, the ground component 225, and the directors 210) may be formed from RF conductive material. For example, the antenna elements 205*a*-205*d* and the ground component 225 may be formed from metal or other RF conducting material. Rather than being provided on opposing sides of the substrate as shown in FIGS. 2A and 2B, each antenna element 205*a*-205*d* is coplanar with the ground component 225.

The antenna components may also be conformally mounted to the housing of the system 100. In such embodiments, the antenna element selector may comprise a separate structure (not shown) from the antenna elements 205*a*-205*d*. The antenna element selector may be mounted on a relatively small PCB and the PCB may be electrically coupled to the antenna elements 205*a*-205*d*. In some embodiments, the switch PCB is soldered directly to the antenna elements 205*a*-205*d*.

Figure 3:
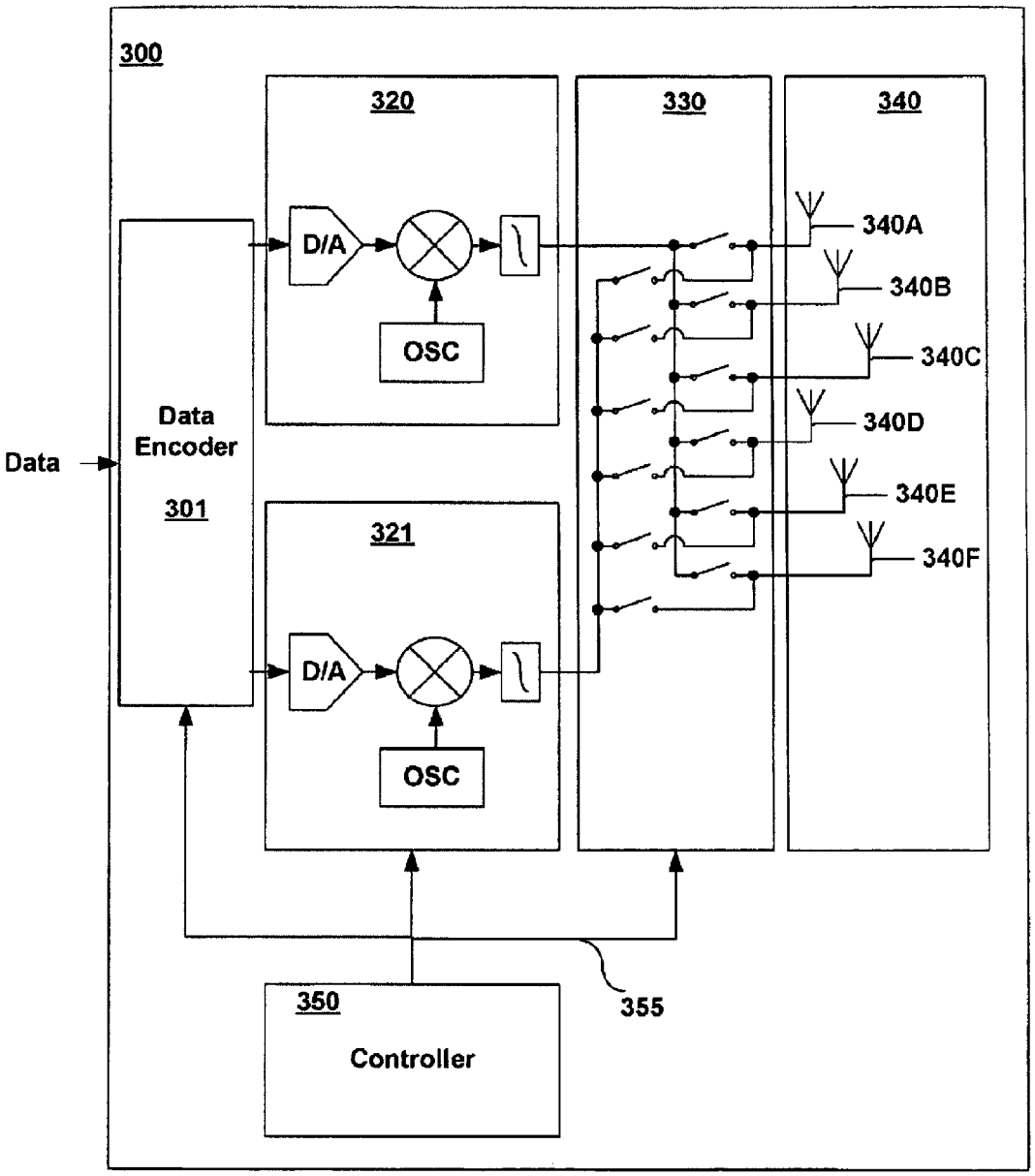
FIG. 3 illustrates a wireless multiple-input-multiple-output (MIMO) antenna system having multiple antennas and multiple radios as may be implemented in a wireless device like that described in FIG. 1.

FIG. 3 illustrates a wireless MIMO antenna system having multiple antennas and multiple radios. A MIMO antenna system may be used as (or part of) the horizontal array 110 of FIG. 1. The wireless MIMO antenna system 300 illustrated in FIG. 3 may be representative of a transmitter and/or a receiver such as an 802.11 access point or an 802.11 receiver. System 300 may also be representative of a set-top box, a laptop computer, television, Personal Computer Memory Card International Association (PCMCIA) card, Voice over Internet Protocol (VoIP) telephone, or handheld gaming device.

Wireless MIMO antenna system 300 may include a communication device for generating a radio frequency signal (e.g., in the case of transmitting node). Wireless MIMO antenna system 300 may also or alternatively receive data from a router connected to the Internet. Wireless MIMO antenna system 300 may then transmit that data to one or more of the remote receiving nodes. For example, the data may be video data transmitted to a set-top box for display on a television or video display.

The wireless MIMO antenna system 300 may form a part of a wireless local area network (e.g., a mesh network) by enabling communications among several transmission and/or receiving nodes. Although generally described as transmitting to a remote receiving node, the wireless MIMO antenna system 300 of FIG. 3 may also receive data subject to the presence of appropriate circuitry. Such circuitry may include but is not limited to a decoder, downconversion circuitry, samplers, digital-to-analog converters, filters, and so forth.

Wireless MIMO antenna system 300 includes a data encoder 301 for encoding data into a format appropriate for transmission to the remote receiving node via parallel radios 320 and 321. While two radios are illustrated in FIG. 3, additional radios or RF chains may be utilized. Data encoder 301 may include data encoding elements such as direct sequence spread-spectrum (DSSS) or Orthogonal Frequency Division Multiplex (OFDM) encoding mechanisms to generate baseband data streams in an appropriate format. Data encoder 301 may include hardware and/or software elements for converting data received into the wireless MIMO antenna system 300 into data packets compliant with the IEEE 802.11 format.

Radios 320 and 321 include transmitter or transceiver elements configured to upconvert the baseband data streams from the data encoder 301 to radio signals. Radios 320 and 321 thereby establish and maintain the wireless link. Radios 320 and 321 may include direct-to-RF upconverters or heterodyne upconverters for generating a first RF signal and a second RF signal, respectively. Generally, the first and second RF signals are at the same center frequency and bandwidth but may be offset in time or otherwise space-time coded.

Wireless MIMO antenna system 300 further includes a circuit (e.g., switching network) 330 for selectively coupling the first and second RF signals from the parallel radios 320 and 321 to an antenna apparatus 340 having multiple antenna elements 340A-F. Antenna elements 340A-F may include individually selectable antenna elements such that each antenna element 340A-F may be electrically selected (e.g., switched on or off). By selecting various combinations of the antenna elements 340A-F, the antenna apparatus 340 may form a "pattern agile" or reconfigurable radiation pattern. If certain or substantially all of the antenna elements 340A-F are switched on, for example, the antenna apparatus 340 may form an omnidirectional radiation pattern. Through the use of MIMO antenna architecture, the pattern may include both vertically and horizontally polarized energy, which may also be referred to as diagonally polarized radiation. Alternatively, the antenna apparatus 340 may form various directional radiation patterns, depending upon which of the antenna elements 340A-F are turned on.

Wireless MIMO antenna system 300 may also include a controller 350 coupled to the data encoder 301, the radios 320 and 321, and the circuit 330 via a control bus 355. The controller 350 may include hardware (e.g., a microprocessor and logic) and/or software elements to control the operation of the wireless MIMO antenna system 300.

The controller 350 may select a particular configuration of antenna elements 340A-F that minimizes interference over the wireless link to the remote receiving device. If the wireless link experiences interference, for example due to other radio transmitting devices, or changes or disturbances in the wireless link between the wireless MIMO antenna system 300 and the remote receiving device, the controller 350 may select a different configuration of selected antenna elements 340A-F via the circuit 330 to change the resulting radiation pattern and minimize the interference. For example, the controller 350 may select a configuration of selected antenna elements 340A-F corresponding to a maximum gain between the wireless system 300 and the remote receiving device. Alternatively, the controller 350 may select a configuration of selected antenna elements 340A-F corresponding to less than maximal gain, but corresponding to reduced interference in the wireless link.

Controller 350 may also transmit a data packet using a first subgroup of antenna elements 340A-F coupled to the radio 320 and simultaneously send the data packet using a second group of antenna elements 340A-F coupled to the radio 321. Controller 350 may change the group of antenna elements 340A-F coupled to the radios 320 and 321 on a packet-by-packet basis. Methods performed by the controller 350 with respect to a single radio having access to multiple antenna elements are further described in U.S. patent publication number US 2006-0040707 A1. These methods are also applicable to the controller 350 having control over multiple antenna elements and multiple radios.

A MIMO antenna apparatus may include a number of modified slot antennas and/or modified dipoles configured to transmit and/or receive horizontal polarization. The MIMO antenna apparatus may further include a number of modified dipoles to provide vertical polarization. Examples of such antennas include those disclosed in U.S. patent application Ser. No. 11/413,461. Each dipole and each slot provides gain (with respect to isotropic) and a polarized directional radiation pattern. The slots and the dipoles may be arranged with respect to each other to provide offset radiation patterns.

For example, if two or more of the dipoles are switched on, the antenna apparatus may form a substantially omnidirectional radiation pattern with vertical polarization. Similarly, if two or more of the slots are switched on, the antenna apparatus may form a substantially omnidirectional radiation pattern with horizontal polarization. Diagonally polarized radiation patterns may also be generated.

The antenna apparatus may easily be manufactured from common planar substrates such as an FR4 PCB. The PCB may be partitioned into portions including one or more elements of the antenna apparatus, which portions may then be arranged and coupled (e.g., by soldering) to form a non-planar antenna apparatus having a number of antenna elements. In some embodiments, the slots may be integrated into or conformally mounted to a housing of the system, to minimize cost and size of the system, and to provide support for the antenna apparatus.

Figure 4A:
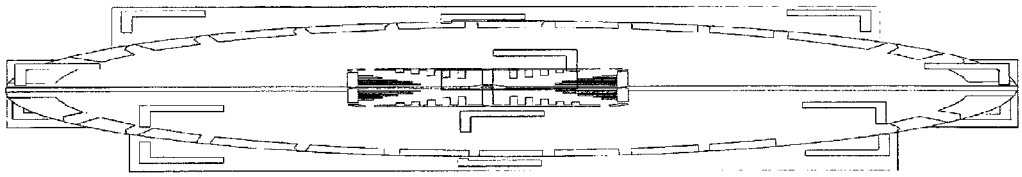
FIG. 4A illustrates a horizontally narrow embodiment of a MIMO antenna apparatus as may be implemented in a wireless device like that described in FIG. 1.
Figure 4B:
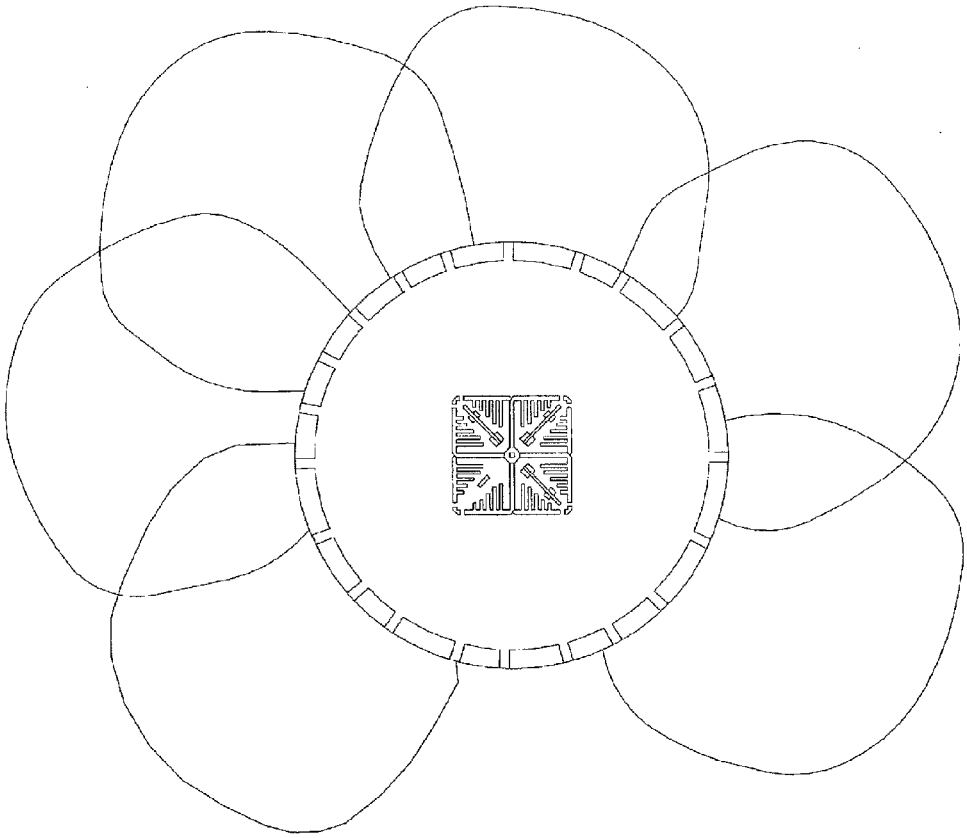
FIG. 4B illustrates a corresponding radiation pattern as may be generated by the embodiment illustrated in FIG. 4A.

FIG. 4A illustrates a horizontally narrow embodiment of a MIMO antenna apparatus (as generally described in FIG. 3) and as may be implemented in a wireless device like that described in FIG. 1. FIG. 4B illustrates a corresponding radiation pattern as may be generated by the embodiment illustrated in FIG. 4A. In the embodiment illustrated in FIG. 4A, horizontally polarized parasitic elements may be positioned about a central omnidirectional antenna. All elements (i.e., the parasitic elements and central omni) may be etched on the same PCB to simplify manufacturability. Switching elements may change the length of parasitic thereby making them transparent to radiation. Alternatively, switching elements may cause the parasitic elements to reflect energy back towards the driven dipole resulting in higher gain in that direction. An opposite parasitic element may be configured to function as a direction to increase gain. Other details as to the manufacture and construction of a horizontally narrow MIMO antenna apparatus may be found in U.S. patent application Ser. No. 11/041,145.

Figure 5:
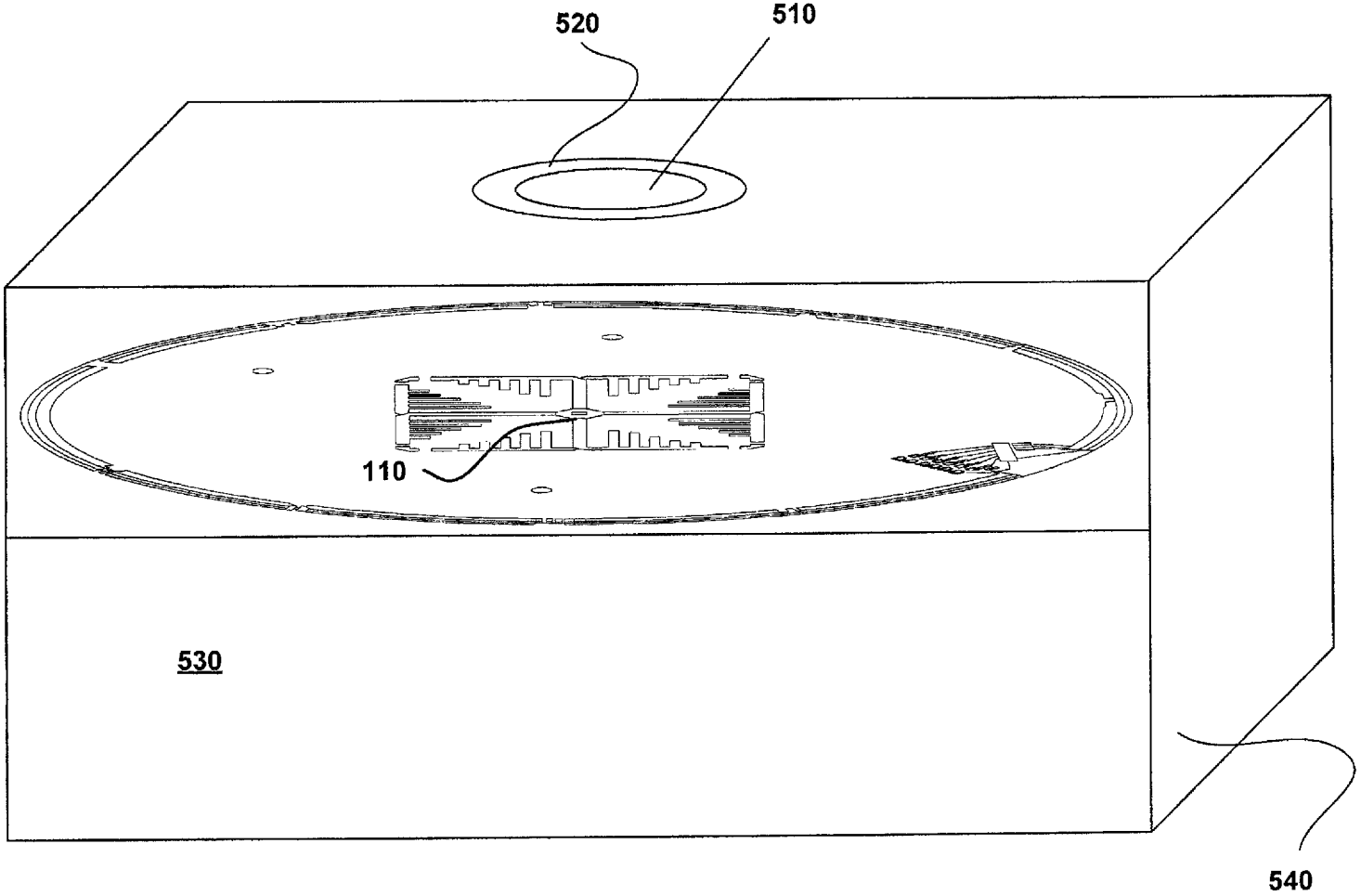
FIG. 5 illustrates an alternative embodiment of FIG. 1, wherein the metallic shaping plate is a metallic ring situated in a plastic or other non-metallic enclosure.

FIG. 5 illustrates an alternative embodiment of FIG. 1. In the embodiment of FIG. 5, the metallic shaping plate 510 is situated in a plastic enclosure 520. The plastic enclosure may fully encapsulate the metallic shaping plate 510 such that no portion of the plate is directly exposed to the interior environment 530 of the wireless device 540.

Alternatively, the plastic may encase only the edges of the metallic shaping plate 510. In such an implementation, at least a portion of the metallic shaping plate 510 is directly exposed to the interior environment of the wireless device 540. By encasing only the edges of the shaping plate 510, the metallic shaping plate 410 may be more easily removed from the casing 520 and replaced in the wireless device 540. Removal and replacement of the metallic shaping plate 510 may allow for different shaping plates with different shaping properties to be used in a single wireless device 540. As such, the wireless device 540 may be implemented in various and changing wireless environments. The casing, in such an embodiment, may be permanently adhered to the interior of the device 540 housing although temporary adhesives may also be utilized.

In some embodiments, a series of metallic shaping plates may be utilized. One plate of particular configuration (e.g., shape, size, thickness, material) may be positioned on top of another shaping plate of a different configuration. In yet another embodiment, a series of rings may surround a single metallic shaping plate. The plate in such an embodiment may have one configuration and each of the surrounding rings may represent a different configuration each with their own shaping properties.

Multiple plates may also be used, each with their own shaping properties. Plates may be located on the interior top and bottom of a housing apparatus, along the sides, or at any other point or points therein. In such an embodiment, the positioning of the plates need not necessarily be centered with respect to an antenna array.

Figure 6:
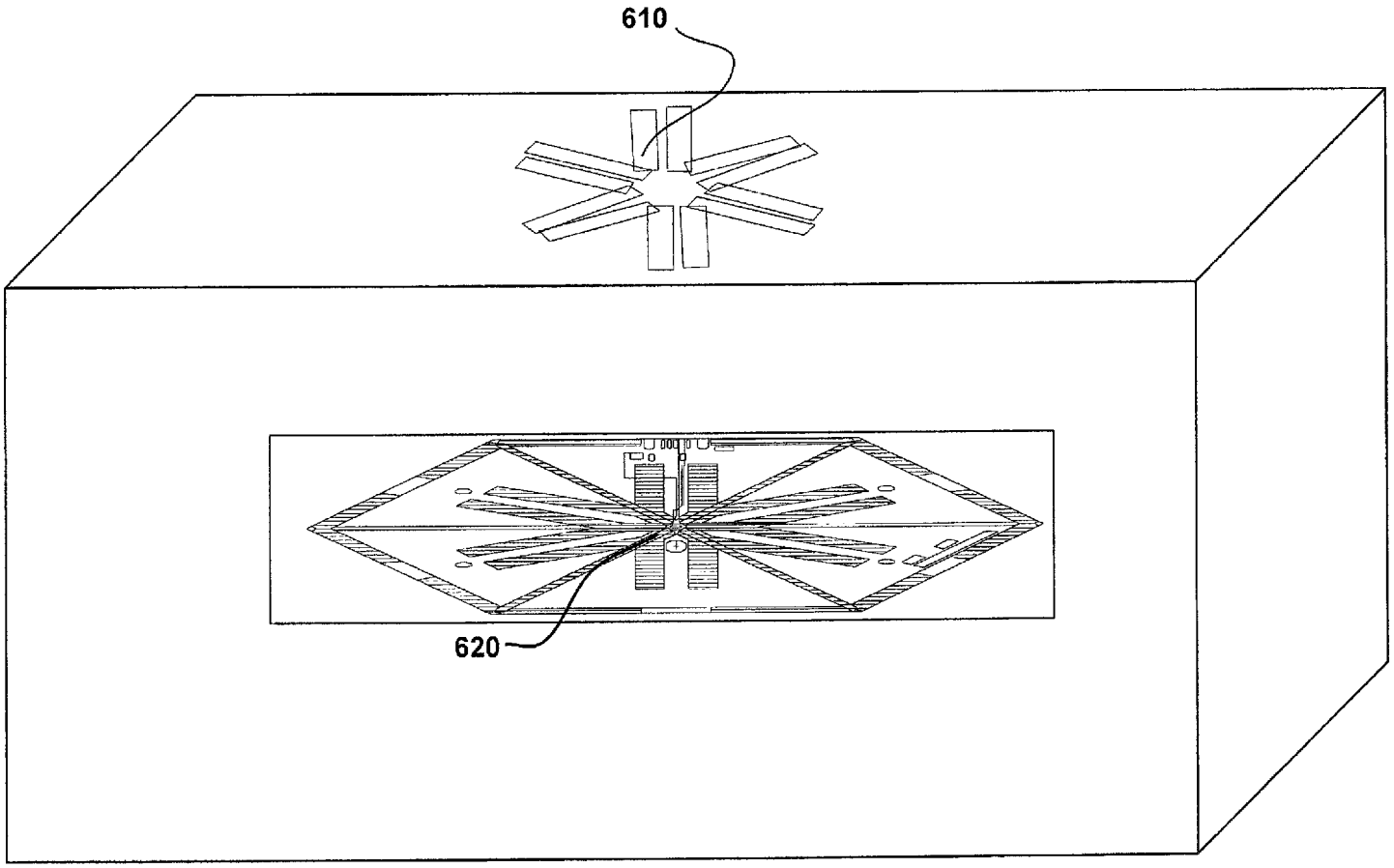
FIG. 6 illustrates a further embodiment of the present invention wherein the metallic shaping plate corresponds, in part, to the element layout design of the antenna array.

FIG. 6 illustrates a further embodiment of the present invention wherein the metallic shaping plate 610 corresponds, in part, to the element layout design of the antenna array 620. The shaping plate, in such an embodiment, may correspond to any particular shape and/or configuration. Various portions of the shaping plate may be made of different materials, be of different thicknesses, and/or be located in various locales of the housing with respect to various elements of the antenna array. Various encasings may be utilized as described in the context of FIG. 5. Other plates may be used in conjunction with the plate of FIG. 6; said plates need not correspond to the shape of the array.

The embodiments disclosed herein are illustrative. Various modifications or adaptations of the structures and methods described herein may become apparent to those skilled in the art. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. An antenna system comprising:

a plurality of antenna elements for selective coupling to a radio frequency feed port;

a housing enclosing the plurality of antenna elements;

a ground component associated with one of the plurality of antenna elements, wherein a portion of the ground component is shaped to form a modified dipole in conjunction with the antenna element; and one or more loading structures configured to slow down electrons to changing a resonance of the modified dipole and to minimize the size of the antenna system.

2. The antenna system of claim 1, wherein at least two of the plurality of antenna elements generate an omnidirectional radiation pattern having less directionality than a directional radiation pattern of a single antenna element when selectively coupled to the radio frequency feed port.

3. The antenna system of claim 1, further comprising a substrate including the plurality of antenna elements.

4. The antenna system of claim 1, wherein the plurality of antenna elements are located on a first side of the substrate.

5. The antenna system of claim 2, further comprising a shaping element coupled to the antenna system for changing the omnidirectional radiation pattern.

6. The antenna system of claim 1, wherein two or more of the plurality of antenna elements are configured to transmit and receive horizontal polarization.

7. The antenna system of claim 1, wherein two or more of the plurality of antenna elements are configured to transmit and receive vertical polarization.

8. The antenna system of claim 1, wherein the plurality of antenna elements includes a first set of antenna elements arranged in a first plane, and a second set of antenna elements arranged perpendicular to the first plane.

9. The antenna system of claim 8, wherein the first set of antenna elements generates a first radiation pattern having a polarization substantially in the first plane, and the second set of antenna elements generates a second radiation pattern having a polarization substantially perpendicular to the first plane.

10. The antenna system of claim 9, wherein at least one of the loading structures is arranged in a third plane parallel to the first plane.

11. The antenna system of claim 1, wherein at least one of the loading structures has a layout corresponding to an arrangement of antenna elements from the plurality of antenna elements.

12. The antenna system of claim 1, wherein at least one of the loading structures includes a first portion located a first distance from the antenna array, and a second portion located a second distance from the antenna array, and wherein the second distance of the second portion is greater than the first distance of the first portion.

* * * * *